US005704135A

United States Patent [19]

Riahi

[11] Patent Number: 5,704,135

[45] Date of Patent: Jan. 6, 1998

[54] INSTANT PHOTOGRAPHIC PRINT DRYING DEVICE

[76] Inventor: Sohrab Riahi, 36 Rainbow Lake, Irvine, Calif. 92614

[21] Appl. No.: 500,267

[22] Filed: Jul. 10, 1995

[51] Int. Cl.[6] ..... F26B 21/06

[52] U.S. Cl. ..... 34/546; 34/562; 34/615; 34/619; 34/621; 219/201; 392/360; 355/72

[58] Field of Search ..... 34/535, 546, 562, 34/60, 615, 619, 621, 202, 225; 219/200, 201, 532, 400, 385, 386, 360; 392/361, 382; 355/72

[56] References Cited

U.S. PATENT DOCUMENTS

| | | | |
|---|---|---|---|
| 1,679,239 | 7/1928 | Cassereau | 34/546 |
| 2,191,163 | 2/1940 | Simmon | 34/621 |
| 2,495,612 | 1/1950 | Trimble | 34/621 X |
| 2,994,134 | 8/1961 | Adams | 34/619 X |
| 2,994,965 | 8/1961 | Tuhy | 34/621 X |
| 3,701,201 | 10/1972 | Drury | 392/382 X |
| 3,811,201 | 5/1974 | Endter et al. | 34/566 |
| 4,087,926 | 5/1978 | Breslau et al. | 34/615 X |
| 4,151,657 | 5/1979 | Jensen et al. | 34/621 |
| 4,286,392 | 9/1981 | Viland | 34/546 X |
| 5,077,570 | 12/1991 | Schell | 396/30 |

FOREIGN PATENT DOCUMENTS

| | | |
|---|---|---|
| 24 27 864 | 7/1975 | Germany . |
| 35 12 980 | 10/1986 | Germany . |
| 1606958 | 11/1990 | U.S.S.R. . |

*Primary Examiner*—John M. Sollecito
*Assistant Examiner*—Steve Gravini
*Attorney, Agent, or Firm*—Daniel R. Kimbell

[57] ABSTRACT

An instant photographic print drying device. The device has a stand which carries a fan and a heating coil. Downstream of the fan the photograph is held in place by clips. A timer is provided which can be set to a prescribed time to dry the photographs. An on/off switch is provided and a momentary switch is optionally present to provide a little more drying time, without resetting the timer. A thermostat might be included to prevent overheating of the coils, and possible overheating and burning of the photograph. Optionally, the clips holding the photograph in place can be connected to a micro-switch, which activates the timer controlling the fan and heating coil when a photograph is placed on the stand.

22 Claims, 4 Drawing Sheets

100
102
104
106
108
110
111
112
113
114
116
118
120
122
124
126
128
130
132
134
136
138

INSTANT PHOTOGRAPHIC PRINT DRYING DEVICE

BACKGROUND OF THE INVENTION

1. Field of the Invention

This invention is related to field of photography, and more particularly to the field of devices to dry instant photographic prints.

2. Background of the Prior Art

There have been numerous attempts to develop useful devices to dry photographic prints. However, in the past, these efforts have been directed to developing print driers for suitable for drying large numbers of prints, i.e. in an assembly line manner.

U.S. Pat. No. 3,800,432 Miyata et al. discloses a conveyor belt system of drying prints which uses a fan and heating source to dry prints passing between two conveyor belts. This device does not disclose a timer to set the drying time.

U.S. Pat. No. 4,142,301 to Goodall discloses a method of drying photographic paper where radiant heat is directed to the back of the photographic paper and an air flow to the image bearing side of the photographic paper.

U.S. Pat. No. 4,151,657 to Jensen et al. is similar to Miyata in that it teaches a drying chamber where photographic film is dried by a non-turbulent filtered and heated air.

U.S. Pat. No. 5,077,570 to Schell discloses a photo processing work station which uses a high velocity fan to dry the print without the use of heating elements.

U.S. Pat. No. 3,681,853 to Reid discloses a photograph print dryer which has a transport mechanism for transporting large sheets of paper through a drying chamber with a fan and heating element.

U.S. Pat. No. 2,435,420 to Beernink discloses a drier for photographic prints arranged in a stack, which uses a fan and heating element.

The invention is a device for drying instant photographs, and is adapted to dry Polaroid® type instant photographs that are commonly used for passports, medical purposes, identification cards, police bookings, among many other purposes. In the present practice, photographers typically utilize a hand held hair drier, either held in the hand, or taped to a counter and the like to speed up the drying of instant photographs. This not only prevents the photographer from serving other customers, but also is unattractive and inefficient. There accordingly remains a need for a device which overcomes the shortcomings of the present method of drying instant photograph pictures.

SUMMARY OF THE INVENTION

The instant photographic print drying device of the invention comprises a stand which carries a fan and a heating coil. Downstream of the fan heating coil the photograph is held in place by clips. A timer is provided which can be set to a prescribed time to dry the photographs. An on/off switch is provided and a momentary switch is optionally present to provide a little more drying time, without resetting the timer. Optionally, the clips holding the photograph in place can be connected to a micro-switch, which activates the fan and heating coils when a photograph is placed on the stand. A thermostat may be included to prevent overheating of the coils, and possible overheating and burning of the photograph. Also, a buzzer, chime, or other audible signal means can also be included in the circuitry to positively notify the user as to when the instant print is dry.

The invention provides a photographic print drying device, comprising:

- a stand which has a back portion, a base portion, and an upper portion;
- clip means positioned on said base portion to detachably hold photographic prints to said stand portion;
- a housing portion with circumferential walls defining an opening therebetween, said housing portion being connected to said upper portion of the stand portion and being spaced away from said base portion;
- a heating element;
- a fan portion with an electric motor and fan blades, said fan portion and said heating portion being contained in said opening of said housing portion; and
- a control panel with circuitry to control the delivery of electricity to said fan portion and heating element for a selectable time.

The invention further provides a photographic print drying device, comprising:

- a stand which has a back portion, a base portion, and an upper portion;
- clip means positioned on said base portion to detachably hold photographic prints to said stand portion;
- a housing portion with circumferential walls defining an opening therebetween, said housing portion being connected to said upper portion of the stand portion and being spaced away from said base portion;
- a heating element;
- a fan portion with a direct current electric motor and fan blades, said fan portion and said heating portion being contained in said opening of said housing portion;
- circuitry to convert alternating current supplied to the device to direct current for said electric motor; and
- circuitry including a timer circuit which will deliver electricity to said fan and heating elements for a selectable time sufficient to dry the photographic prints.

The inventions yet further provides a photographic print drying device, comprising:

- a housing portion with circumferential walls defining an opening therebetween;
- a heating element;
- a fan portion with an electric motor and fan blades, said fan portion and said heating portion being contained in said opening of said housing portion;
- circuitry to control the delivery of electricity to said fan portion and heating element for a selectable time;
- a photographic print drying tray have side walls, a floor, and a rearwardly slanting rear wall, with said housing portion and its contained fan portion and heating portion contained therein being attached to said print drying tray opposite said rearwardly slanting rear wall; and
- clip means to detachably hold photographic prints to be dried to said rearwardly slanting rear wall.

BRIEF DESCRIPTION OF THE DRAWINGS

FIG. 4 is a schematic drawing showing the electrical circuitry of the device.

DETAILED DESCRIPTION OF THE INVENTION

Figure 1:
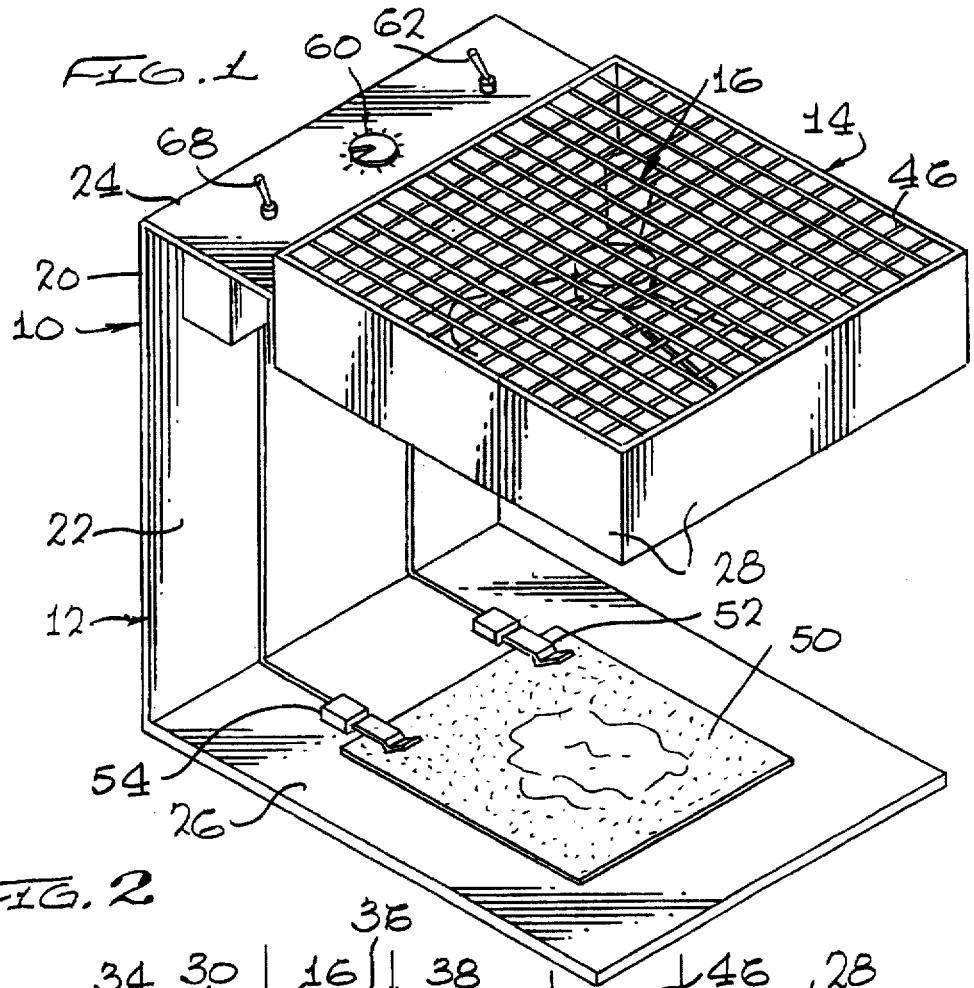
FIG. 1 is a partial exposed perspective view of the first embodiment of the photographic print drying device of the invention.
Figure 2:
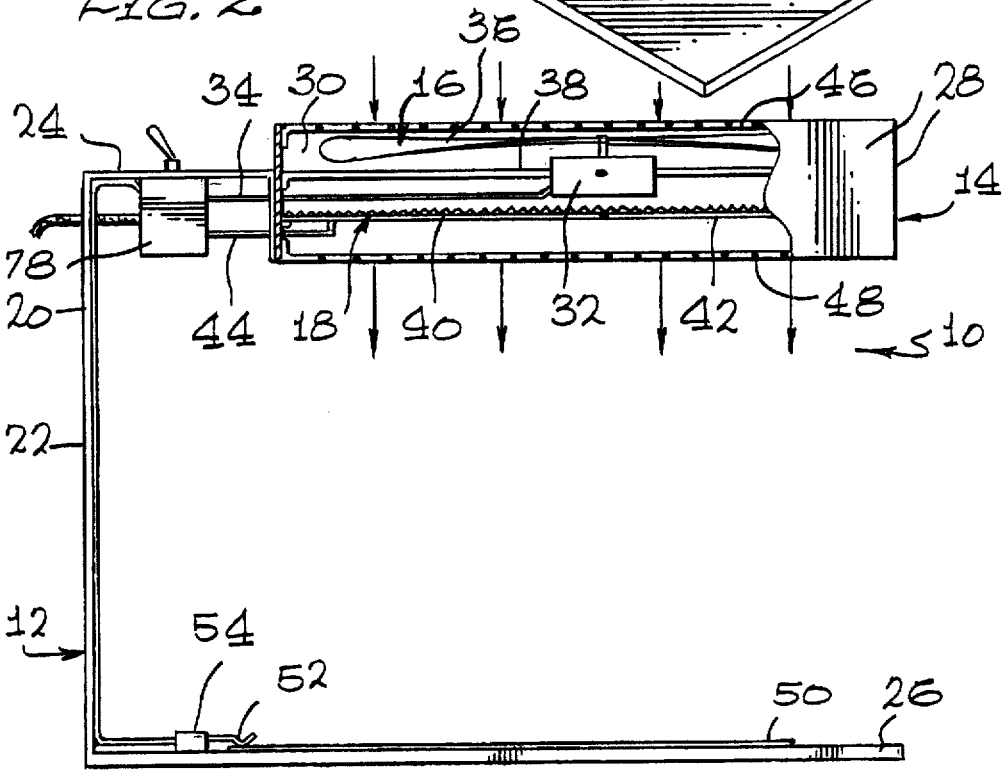
FIG. 2 is a side view of the photograph print drying device of the invention of FIG. 1.
Figure 3:
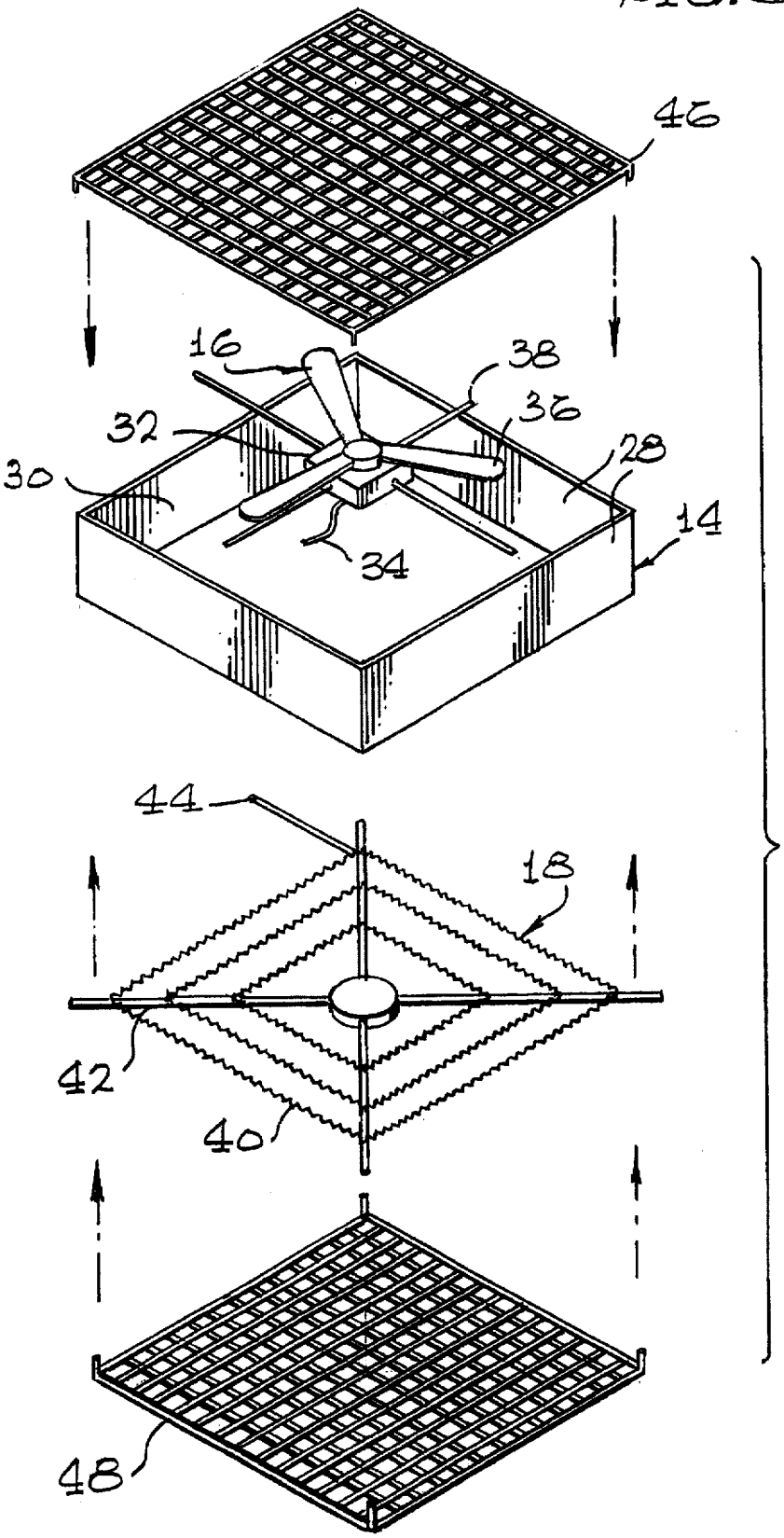
FIG. 3 is an exploded perspective view of the housing, the fan, and the heating coil of the device of FIG. 1.
Figure 9:
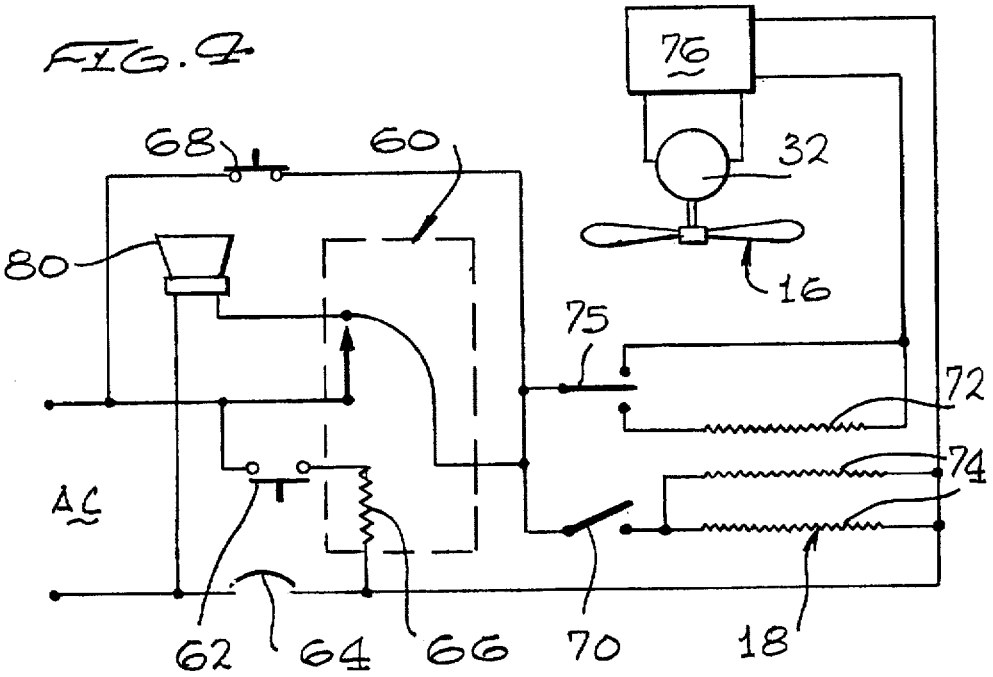

Referring to FIGS. 1–3, the instant photographic print drying device 10 of the invention includes a stand 12 which carries a housing 14 for a fan 16 and a heating coil 18. The housing 14 is carried at an upper region 20 of a back wall 22 of the stand 12. A control panel 24 is located adjacent the housing 14. The stand 12 has a base or standoff portion 26 spaced below and underlying the housing 14. The arrangement of the back wall 22, housing 14 and base portion 26 thus provides a stable structure, with the weight of the housing 14 and its carried fan 16 and heating coil 18 suspended over the base portion 26.

Referring to FIG. 2 and 3, the housing 14 has circumferential sidewalls 28 defining an opening 30 therebetween. The fan 16 is positioned in the opening 30 of the housing 14. The fan 16 has an electric motor (preferably DC) 32 and power wires 34. Fan blades 36 (i.e. made out of plastic) are oriented and positioned on the electric motor 32 such that when the fan 16 is on, the resulting air flow will be directly downwardly. The electric motor 32 is carried on bracket arms 38 which join with the sidewalls 28 of the housing 14. The heating coil 18 comprises electrical resistance heating wires 40 which are carried on a non-conducting structure 42, such as on ceramic support bars, which support the heating wires 40 in the housing's opening 30 at a position below and downstream of the fan 16. Heating coil power wires 44 provide electrical power to the heating coil 18. A first upstream safety fence 46 is positioned on the housing 14 above the fan 16 to cover the opening 30 and prevent anyone or anything from accidentally touching the fan blades 36 or heating coil 18 during operation of the device. A second downstream safety fence 48 is positioned on the housing 14 below the heating coils 18 to prevent anyone or anything from touching the heating coil 18 and/or fan 16. The fan's power wires 34 and the heating coil's power wires 44 lead out of the housing 14 to the control panel 24. Although the fan 16 and heating coil 18 have been described with the fan 16 positioned upstream of the heating coil 18, the order could be reversed, although the heating efficiency would likely be reduced.

The stand 12, control panel 24, and housing 14 of the device 10 can be formed of materials such as non-conducting plastic, or metal, as desired.

Downstream of the housing 14 the instant photograph to be dried 50 is detachably held in place on the base portion 26 below the fan 16 and heating coil 18 by at least one, and preferably by at least two clip means 52. Optionally, the clip means 52 can be connected to a micro-switch 54, such that the state of the microswitch 54 is changed when a photographic print 50 to be dried is slipped into the clip means 52.

Referring now the schematic drawings of FIG. 4, the device 10 has a timer switch 60 which is activated by a momentary switch 62. The timer switch 60 can be set to delivery an closed position for a desired time, such as from 1 to 180 seconds or longer. The timer switch 60 will direct electricity flow to the electric fan motor 32 and to the heating coil 18 for the desired amount of time. The fan 16 will thus blow air across the heating coil 18 for a predetermined or selectable time to dry the instant photograph print 50. The user can set the desired drying time once, and it will be reset each time the momentary switch 62 is activated. The momentary switch 62 can comprise the micro-switch 54 connected to the clip means 52 which will hold the photographic print 50, or can be a separate switch. A circuit breaker 64 and thermostat 66 and preferably provided to prevent accidental overheating of the system. A second momentary switch 68 can also be provided to selectively deliver short bursts of electricity to the fan 16 and heating coil 18, so long as the user presses it. This second momentary switch 68 will be convenient in the event a slightly longer burst of warm air flow is desired, for example, in cases where the photographic print 50 is extra moist, or the day is extra cold and damp, and a slightly longer drying time is desired. Optionally, a heating coil selection switch 70 can be provided in the event that the heating coil 18 has two separate heating elements 72 and 74, such that current will flow through heating element 72 only, or through both heating elements 72 and 74. The heating elements 72 and 74 will be convenient in the event that selectivity in the level of heat of the air flow is desired, i.e. a low and high setting. In addition to this, another selection switch 75 is provided to bypass the heating coil 72 in cases where no heating is required or desired. In this case, the switch 70 should also be in the off position. In cases where the heating coils 72, or 72 and 74 are not used to reduce the voltage, other devices (i.e. resistors) can be utilized (not shown.)

Conventional circuitry, i.e. a full wave rectifier (depicted as blackbox 76) is utilized to convert the standard alternating current (AC) to a clean, smooth, filtered and regulated direct current (DC) for use by the electrical motor 32 in cases where a DC motor is utilized. Also, a buzzer, chime, speaker, or other audible signal means 80 can also be included in the circuitry to positively notify the user when the timer's time has elapsed, and the instant photographic print 50 is ready. Referring back to FIGS. 1 and 3, the many of the various components of the circuitry can conveniently be located in the control panel 24 in a box 78.

Figure 7:
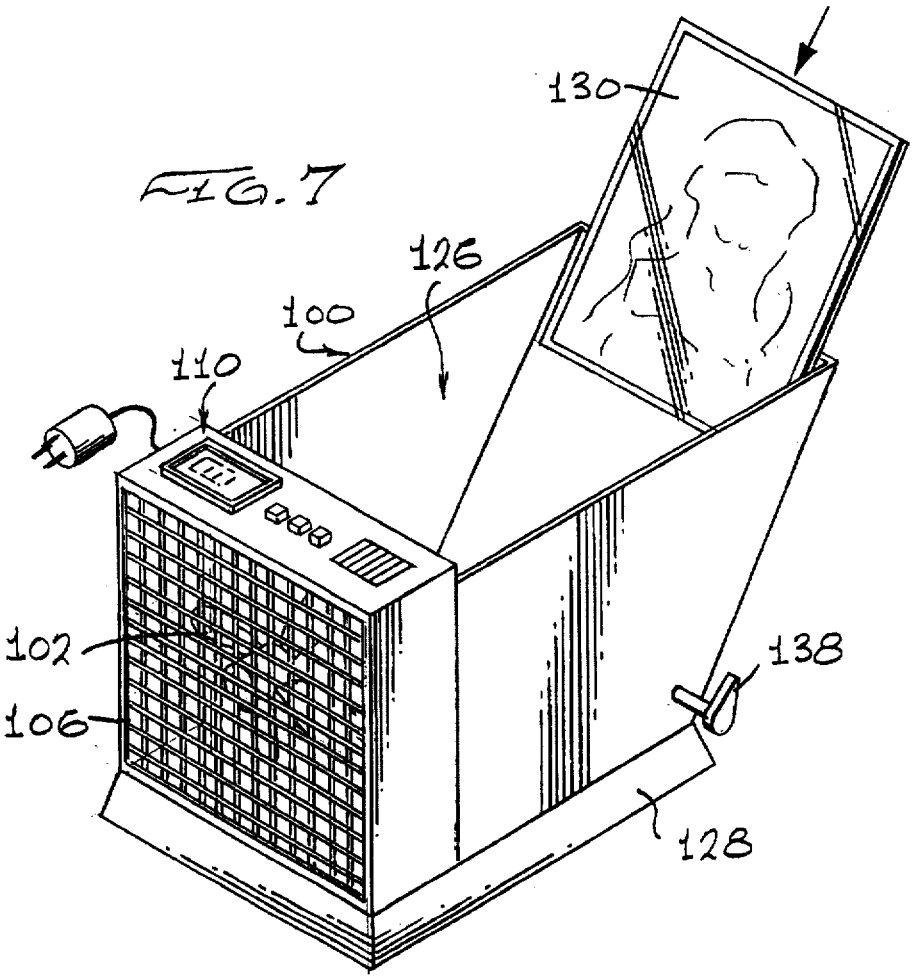
FIG. 7 is a perspective view of the device of FIG. 5
Figures 5, 6:
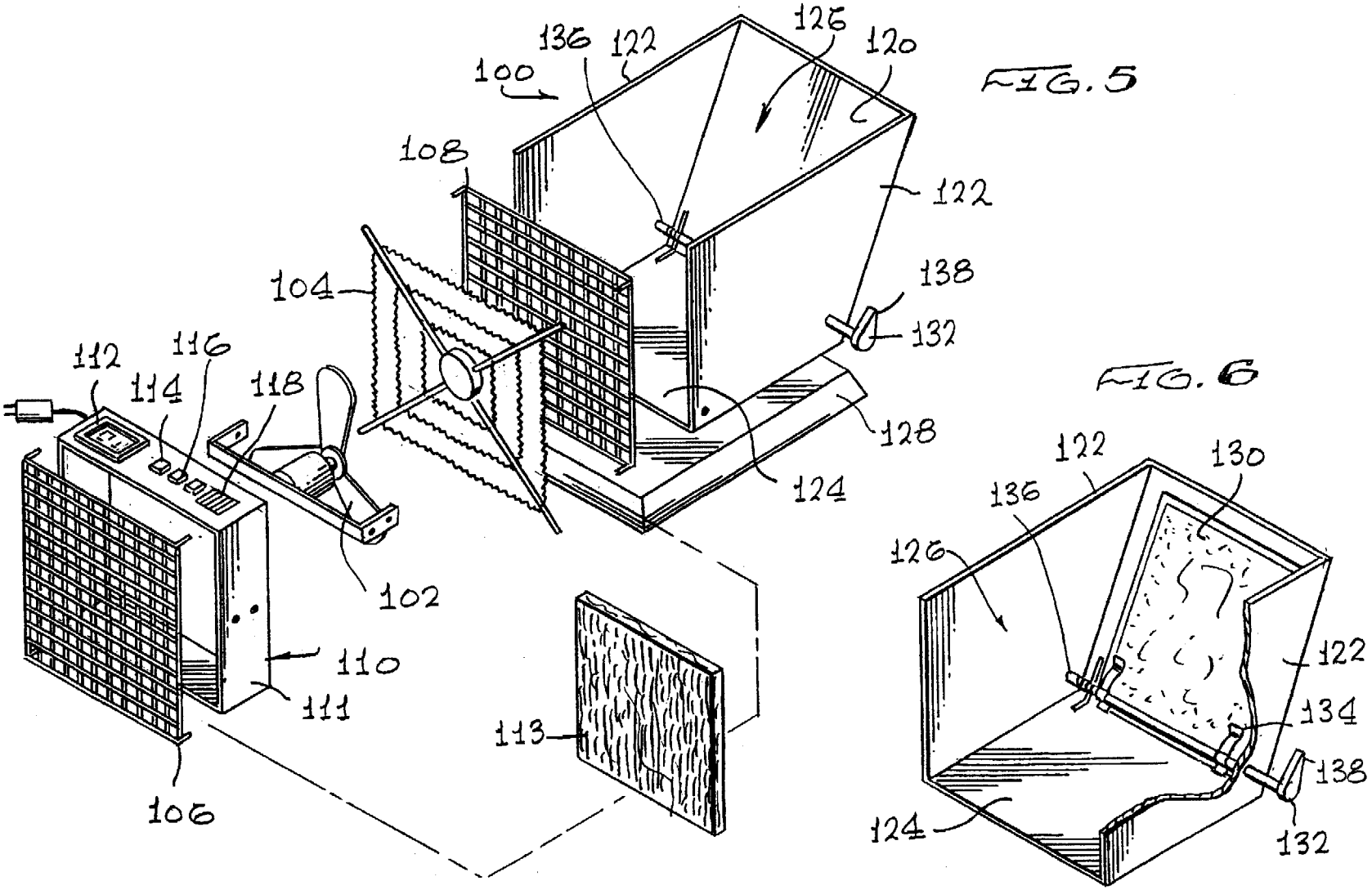
FIG. 5 is an exploded perspective view of a second embodiment of the photographic print drying device of the invention.
FIG. 6 is a partially exposed detail depicting how a photograph to be dried in the device of FIG. 5 is held in place.

Referring to FIGS. 6–8, a second embodiment of the instant photographic print drying device 100 of the invention is shown. In this embodiment, the fan 102, heating coils 104, front and rear safety fences 106 and 108 are mounted within in a generally vertical plane in a housing body 110 with circumferential walls 111. If desired, air filters 113 can be placed in front of one or both of the safety fences 106 and/or 108, to assure that the air flow flowing across the photo to be dried is free from foreign objects and dust. The vertical housing also carries a digital timer 112, an on-off switch 114, a hot-cold switch 116 to permit the user to control the heating of the heating coil 104, and a cycle end alarm 118 to notify the user that the drying cycle is complete. Located a distance downstream from the housing body 110 is a rearwardly slanting photographic print carrying wall 120. A pair of side walls 122 join the photographic print carrying surface 120 at side edges and extend forwardly, and have a floor 124. The side walls 122, the rearwardly slanting photographic print carrying wall 120 and floor 124 define a print drying tray 126. The housing body 110 and its contained elements fit with the drying tray 126 opposite the rearwardly slanting photographic print carrying wall 120. Thus, air draw through the front safety fence 106, the fan 102, the heating coils 104 and out through the rear safety fence 108 will blow against the rearwardly slanting photographic print carrying wall 120, and will impinge thereon. However, since the photographic print carrying wall 120 is rearwardly slanting, air impinging thereon will deflect upwardly, and will minimize potentially disruptive air flow out of unit 100. The print drying tray 126 and the housing body 110 and its contained elements, can, if desired, be attached to a base 128. In order to provide for quick securement of the print 130 to the rearwardly slanting photographic print carrying wall, a spring loaded lever (or "photo push holder") 132 with fingers 134 can be positioned with its shaft (or "spring loaded bar") 136 rotatably carried on the side walls 122, with a lever handle 138 being accessible by the user. The fingers 134 are attached to the shaft 136 and will be used to retain the photograph P to be dried. By turning the lever handle 138, the fingers 134 will move out of contact with the photographic print P, and it can be quickly and easily released. Other means to secure the photographic print P to be dried can also be used.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. A photographic print drying device, comprising:

a stand which has a base portion, a stand portion, and an upper portion;

clip means positioned on said base portion to detachably hold photographic prints to said stand portion;

a housing portion with circumferential walls defining an opening therebetween, said housing portion being connected to said upper portion of the stand portion and being spaced away from said base portion;

a heating element;

a fan portion with an electric motor and fan blades, said fan portion and said heating element being contained in said opening of said housing portion; and a control panel with circuitry to control the delivery of electricity to said fan portion and heating element for a selectable time.

2. The photographic print drying device of claim 1, wherein said circuitry comprises a timer circuit which will delivery electricity to said fan and heating element for a selectable time sufficient to dry the photographic prints.

3. The photographic print drying device of claim 1, wherein said circuitry further comprises a thermostat to prevent overheating of said heating element.

4. The photographic print drying device of claim 2, wherein said circuitry further comprises a momentary switch to activate said timer circuit.

5. The photographic print drying device of claim 4, wherein said momentary switch is connected to and activated by movement of said clip means.

6. The photographic print drying device of claim 2, wherein said circuitry further comprises a momentary switch to deliver momentary current to said fan and heating elements without resetting said timer circuit.

7. The photographic print drying device of claim 2, wherein said heating element comprise a plurality of separate heating coils and a switch to permit a user to activate at least one of said plurality of said heating coils.

8. The photographic print drying device of claim 1, wherein said electric motor operates on direct current and the device further comprises a means to convert alternating current supplied to the device to direct current for said electric motor.

9. The photographic print drying device of claim 2, wherein said circuitry further comprising an audible signal means to notify the user when the photographic print is dry.

10. The photographic print drying device of claim 1, wherein said stand and housing portion are formed of nonconducting material.

11. The photographic print drying device of claim 1, further comprising safety fences which covers the openings of the housing portion.

12. A photographic print drying device, comprising:

a stand which has a base portion, a stand portion, and an upper portion;

clip means positioned on said base portion to detachably hold photographic prints to said stand portion;

a housing portion with circumferential walls defining an opening therebetween, said housing portion being connected to said upper portion of the stand portion and being spaced away from said base portion;

a heating element;

a fan portion with a direct current electric motor and fan blades, said fan portion and said heating element being contained in said opening of said housing portion;

circuitry to convert alternating current supplied to the device to direct current for said electric motor; and a control panel with circuitry to control the delivery of electricity to said fan portion and heating element for a selectable time, said circuitry including a timer circuit which will delivery electricity to said fan and heating elements for a predetermined time sufficient to dry the photographic prints.

13. The photographic print drying device of claim 12, wherein said circuitry further comprises a momentary switch to activate said timer circuit.

14. The photographic print drying device of claim 13, wherein said momentary switch is connected to said clip means.

15. The photographic print drying device of claim 12, wherein said circuitry further comprises a momentary switch to deliver momentary current to said fan and heating element without resetting said timer circuit.

16. The photographic print drying device of claim 12, wherein said heating element comprises a plurality of heating coils and a switch to permit a user to activate at least one of said plurality of heating coils.

17. The photographic print drying device of claim 12, wherein said circuitry further comprising an audible signal means to notify the user when the photographic print is dry.

18. The photographic print drying device of claim 12, wherein said stand and housing portion are formed of nonconducting material.

19. A photographic print drying device, comprising:

a housing portion with circumferential walls defining an opening therebetween;

a heating element;

a fan portion with an electric motor and fan blades, said fan portion and said heating element being contained in said opening of said housing portion;

circuitry to control the delivery of electricity to said fan portion and heating element for a selectable time;

a photographic print drying tray having side walls, a floor, and a rearwardly slanting rear wall, with said housing portion and its contained fan portion and heating element contained therein being attached to said print drying tray opposite said rearwardly slanting rear wall; and clip means to detachably hold photographic prints to be dried to said rearwardly slanting rear wall.

20. The photographic print drying device of claim 19, wherein said circuitry comprises a timer circuit which will delivery electricity to said fan and heating element for a selectable time sufficient to dry the photographic prints, and a hot cold switch to control power to the heating element.

21. The photographic print drying device of claim 19, wherein said clip means comprises a spring activated rotatable shaft with finger means and a handle.

22. The photographic print drying device of claim 19, further comprising safety fences which cover the openings of the housing portion.

* * * * *